US008786655B2

(12) United States Patent
Liu et al.

(10) Patent No.: US 8,786,655 B2
(45) Date of Patent: Jul. 22, 2014

(54) MARKING MATERIAL FOR LASER GLOSSING SYSTEMS AND METHODS

(71) Applicant: Xerox Corporation, Norwalk, CT (US)

(72) Inventors: Chu-heng Liu, Penfield, NY (US); Nancy Y. Jia, Webster, NY (US); Jing Zhou, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/627,245

(22) Filed: Sep. 26, 2012

(65) Prior Publication Data

US 2014/0085396 A1 Mar. 27, 2014

(51) Int. Cl.
*B41J 2/47* (2006.01)

(52) U.S. Cl.
USPC ..... 347/240; 347/251

(58) Field of Classification Search
USPC ..... 347/115, 124, 156, 225, 240, 251–253
See application file for complete search history.

(56) References Cited

U.S. PATENT DOCUMENTS 6,946,228 B2 * 9/2005 Kanamaru et al. ..... 430/108.4
2008/0101832 A1 * 5/2008 Yaoi et al. ..... 399/336

* cited by examiner

*Primary Examiner* — Hai C Pham
(74) *Attorney, Agent, or Firm* — Ronald E. Prass, Jr.; Prass LLP

(57) ABSTRACT

A system for generating a differential gloss image includes a marking material having absorbing elements useful for absorbing electromagnetic radiation emitted by a laser glossing imager, and accommodating heating and resultant melting of the marking material for altering a surface of the marking material image. The absorbing element is a pigment or dye. The absorbing element is carbon black, or a pigment capable of absorbing IR light, while being transparent to visible light.

16 Claims, 1 Drawing Sheet

MARKING MATERIAL FOR LASER GLOSSING SYSTEMS AND METHODS

RELATED APPLICATIONS

This application is related to co-pending U.S. patent application Ser. No. 13/462,485 titled "METHODS AND APPARATUS FOR GENERATING DIFFERENTIAL GLOSS IMAGE USING LASER ENERGY;" co-pending U.S. patent application Ser. No. 13/539,421 titled "METHODS AND SYSTEMS FOR GENERATING DIFFERENTIAL GLOSS IMAGE USEFUL FOR DIGITAL PRINTING;" co-pending U.S. patent application Ser. No. 13/539,416 titled "METHODS AND SYSTEMS FOR GENERATING DIFFERENTIAL IMAGE BY PRE-HEATING PRINTED IMAGE;" and co-pending U.S. patent application Ser. No. 13/597,537 titled SYSTEMS AND METHODS FOR PRINTING DIFFERENTIAL GLOSS IMAGE DIRECTLY ON PACKAGING, the disclosures of which are incorporated by reference herein in their entireties.

FIELD OF DISCLOSURE

The disclosure relates to systems for producing differential gloss images. In particular, the disclosure relates to ink and toner systems that are advantageous for differential gloss image production.

BACKGROUND

Gloss is an image or substrate attribute that pertains to a degree of specular reflection from a surface of a substrate or marking material image on a substrate. Specular reflection is the mirror-like reflection of incident light from a surface. Because the surface of the substrate or marking material image may not be perfectly flat, the light reflected from the surface of the substrate is not similar to what would generally be reflected from a mirror. When a surface of a substrate is rough, the percentage of the light that is reflected as specular reflection is less. In general, the rougher the surface, the less chance there is of the reflected light traveling in the direction of the specular reflection. By varying the roughness of the surface, different types of finishes may be achieved.

SUMMARY

Methods and apparatus for laser glossing, or generating a differential gloss image by applying energy to marking material on a substrate to vary the roughness of the image surface are disclosed in U.S. patent application Ser. No. 13/462,485 titled "METHODS AND APPARATUS FOR GENERATING DIFFERENTIAL GLOSS IMAGE USING LASER ENERGY." The marking material on the substrate may form an original image, and the differential gloss image constitutes a second image overlaying the original image. Methods and systems for generating differential gloss images by applying energy to select portions of marking material on a substrate based on variable data are disclosed in U.S. patent application Ser. No. 13/539,421 titled "METHODS AND SYSTEMS FOR GENERATING DIFFERENTIAL GLOSS IMAGE USEFUL FOR DIGITAL PRINTING." The energy may be applied to the marking material by way of electromagnetic radiation emitted by a laser of an imaging device.

It has been found that related art marking material is not optimally compatible with laser glossing methods and systems. For example, related art solid ink prints may not work with laser glossing systems due to lack of sufficient light absorption at a wavelength of light emitted by the laser imager. Systems for laser glossing a marking material image to generate a differential gloss image are provided that include enhanced marking material configured for effective laser glossing.

In an embodiment, systems may include a marking material system for generating a differential gloss image using a laser glossing imager configured to expose a portion of a printed image to electromagnetic radiation, comprising a marking material for forming the printed image; and an absorbing element configured to absorb the electromagnetic radiation, the absorbing element being a component of the marking material. Systems may include the marking material further comprising a resin or binder, the resin or binder being a resin or binder that melts at a temperature of less than 250 degrees Celsius.

In an embodiment, systems may include the marking material further comprising a resin or binder, the resin or binder being a resin or binder that melts at a temperature of less than 150 degrees Celsius. Systems may include the marking material further comprising a thermal plastic or wax the thermal plastic or wax being a thermal plastic or wax that melts at a temperature of less than 250 degrees Celsius. Systems may include the marking material comprising at least one colorant component, the absorbing element comprising at least one of the at least one colorant component.

The absorbing member may be a pigment or a dye. The absorbing element may be carbon black. The laser glossing imager may comprise an IR laser, the absorbing element being IR light absorptive. In an embodiment, the IR light absorptive absorbing element may be transparent to visible light. In an embodiment, the absorbing element may have an un-even distribution in the marking material for enabling uneven heating of portions of the marking material when exposed to electromagnetic radiation from the laser glossing imager. In an embodiment, the absorbing element may be disposed in the marking material in a concentration sufficient to impart an attenuation length of 0.5 to 10 micrometers in the marking material. In an embodiment, the absorbing element may be disposed in the marking material in a concentration of 0.1 to 5%.

In an embodiment of systems, a marking material system for generating a differential gloss image may comprise a marking material for forming the printed image, the marking material comprising an IR light absorptive absorbing element, the absorbing element being transparent to visible light; and a laser glossing imager configured to expose a portion of the printed image to IR light for absorption by the absorbing element. The absorbing element may be a pigment or a dye. In an embodiment, the absorbing element may have a grainy distribution in the marking material.

Exemplary embodiments are described herein. It is envisioned, however, that any system that incorporates features of apparatus and systems described herein are encompassed by the scope and spirit of the exemplary embodiments.

DETAILED DESCRIPTION

Figure 1:
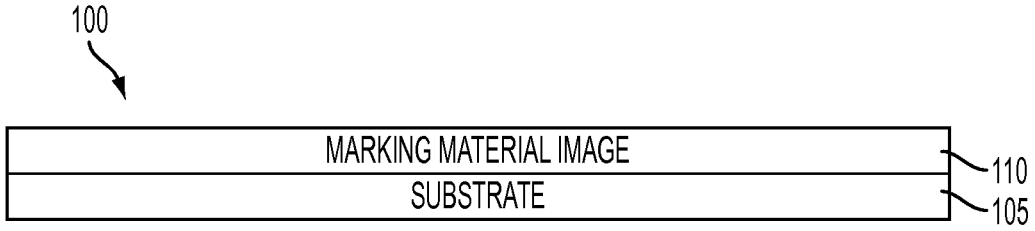
FIG. 1 shows a diagrammatical view of a marking material image on a substrate.

Exemplary embodiments are intended to cover all alternatives, modifications, and equivalents as may be included within the spirit and scope of the methods and systems as described herein.

Laser glossing systems and methods are disclosed in the '485 application. Systems are configured to generate differential gloss on a printed image by exposing the printed image to radiation emitted by an imaging device, such as electromagnetic radiation emitted by a laser glossing imager. The portion of the marking material exposed to the radiation absorbs the radiation, causing the portion to be heated to a temperature sufficient to melt the marking material, altering a surface of the printed image to generate a differential gloss. The printed marking material image is disposed on a substrate that is configured to remain substantially unaffected by radiation emitted by the high power laser. As disclosed in the '421 application, the one or more portions of the printed image may be selectively exposed to a laser beam emitted by the imaging device according to variable data. In particular, methods may include receiving data at a digital front end (DFE), and generating a differential gloss image on a toner image based on the received data. Such methods and systems are useful for generating differential gloss images in variable data printing, a form of digital printing, including on-demand printing, in which elements such as text, graphics, and images may be changed from one print to the next.

In particular, laser glossing systems may include an image production device having a gloss image creation section comprising an imaging device including a laser glossing imager. A high power laser of the laser glossing imager may be configured to melt one or more portions of a printed image on a substrate. The printed image may be formed of a marking material, and may be a toner image or an ink image produced by an image production section of the image production device, or produced by a separate imaging device. While the substrate remains substantially unaffected by the radiation emitted by the laser glossing imager, the one or more portions of the toner image or ink image are selectively exposed to radiation emitted by the laser glossing imager for causing a surface of the printed image to be altered, thereby generating a differential gloss image.

A gloss image creation section of an image production device may include an imaging device such as a laser imager or laser glossing imager configured to output a laser beam in a certain pattern, or onto one or more portions of a marking material image. This may cause different levels of roughness on, e.g., the toner image, and therefore affect a gloss appearance. The gloss creation section and laser glossing imager may be a separate module, or may be implemented as part of another module or component of an image production device.

A laser glossing imager may be configured so that the power of the laser energy emitted from the laser glossing imager is sufficient enough to cause melting of the toner image, while being insufficient to cause evaporation or ablation of the toner image or the substrate. For example, the laser glossing imager may be configured to meet energy requirements of about 1 kW/cm2 (or in a range of 100 to 10000 W/cm2) for power density, and about 1 J/cm2 (or in a range of 0.1 to 10 J/cm2) for energy density. The energy requirements for a laser glossing imager differs from the energy requirements typically associated with laser ablation/engraving techniques where the laser energy is strong enough to be used in etching application of hard materials (e.g., stone, ceramic, etc.). For example, the typical laser energy requirements for laser ablation/engraving may be in a range of 1 to 100 MW/cm2 for power density, and a range of 1 to 100 J/cm2 for energy density, where MW is Mega Watts. In addition, the laser ablation/engraving techniques may cause evaporation or removal of the material, whereas there is minimal or no evaporation or removal of the material caused by the embodiments of the present invention. A laser glossing imager has energy requirements that also differ from that of lower-power laser imagers typically used for electrophotography, as in a laser printer. Laser glossing of existing printed images using a high power laser imager alters surface roughness of the printed image to produce gloss image with high resolution and strong contrast.

FIG. 1 shows a print 100 including a substrate 105 and a marking material image 110 disposed thereon. The marking material may be ink or toner, and may be disposed by an image production device to form the marking material image 110 on the substrate 105. The marking material image 110 may be formed on the substrate 105 by a marking device of an image production device such as a xerographic printing system, which may be used to form a toner image that constitutes the marking material image 110. Alternatively, an ink jet printing system may be used to form an ink image that constitutes the marking material image 110. The substrate 105 may be flexible (e.g., paper, transparency, etc.), and/or may be suitable for packaging.

The marking material image 110 may be a film of certain thickness (e.g., five microns) with an amount of embedded dyes or embedded pigments. The dyes or pigments may capable of absorbing the laser energy and may thereby be heated to a temperature causing marking material of the marking material image 110 to melt. The substrate 105 may serve as a heat sink that draws thermal energy away from the marking material image 110. The print 100 may be cooled by a cooling section as shown in, for example, the '485 application, after laser glossing.

Before laser glossing, the marking material image 110 may have uniform gloss. The marking material image 110 shown in FIG. 1 is generally flat and uniform at the visual scale across a surface of the image 110. For photography or print applications, for example, common finishes desirable by the consumers are glossy finish and matte finish, both of which are formed by a uniform surface of the image 110. A surface profile of the printed image may be altered by laser glossing to produce a differential gloss effect. In general, differential gloss refers to a glossy finish that may be achieved by providing a contrast of image portions that are glossier than other image portions. For example, surfaces with greater roughness will typically be less glossy. By modulating the surface roughness in an image-wise fashion, an image with distinct gloss contrast can be created.

It has been found that laser glossing systems using a high power laser as disclosed above may be ineffective for laser glossing certain image areas of a marking material image. It has been found that related art solid ink prints, for example, are not effectively laser glossed by a laser imager emitting IR light due to their inability to sufficiently absorb light having a wavelength in the IR range.

Marking material images formed using hot melt resin such as toner or hot melt ink may be re-melted by subjecting the marking material to high temperatures, such as those temperatures used to melt the marking material when forming the printed image. A marking material image may be re-heated as such using a laser glossing system to expose the image. A high power laser of an imaging device of laser glossing system may be configured to emit laser pulses for localized heating at portions of a marking material image over a short time period (e.g., about 10 microseconds to about 1 millisecond). Small regions of the heated portion absorb light energy by way of absorbing elements, such as individual toner or pigment particles comprising the portion of the marking material image that absorb light having wavelength corresponding to a wavelength of light emitted by the laser glossing imager. The marking material image subjected to laser during the laser glossing process may then be cooled.

As discussed above, when a printed marking material image is subject to laser glossing, the image surface develops roughness characteristics that differ from the original image surface, i.e., an image surface that has been formed by typical image fusing, curing, and/or solidification processes, which often rely on slow and uniform heating and applying contact pressure during cooling and/or heating. The resulting distinct roughness characteristic results in high contrast gloss, i.e., a differential gloss. Marking material may be configured for effective laser glossing by ensuring that the marking material satisfies certain criteria.

In particular, marking material resin (toner) or binder (ink) used to form a printed image to be laser glossed must have a low melting point. Preferably, the marking material melts at a temperature of less than 500 degrees Celsius. More preferably, the marking material melts at a temperature of less than 250 degrees Celsius. The marking material may preferably be formed of thermal plastics, waxes, etc. that facilitate melting of the marking material at such temperatures.

The ink or toner should be formed of one or more components that enable efficient absorption of laser energy or electromagnetic radiation at a wavelength of light corresponding to a laser beam emitted by a laser glossing imager. The laser energy or light absorbing components of the marking material may comprise the colorant of the marking material. Alternatively, or in combination, components of the marking material other than the colorant may be configured or selected to constitute a laser power absorbing component. The absorbing component may comprise colorant that imparts visible color that forms the image. Alternatively, the absorbing component may comprise colorant that absorbs light in the IR range, but is transparent when exposed to light in the visible range.

A strength of the laser energy absorbing component is preferably sufficient to accommodate an attenuation length or absorption length of laser light in the marking material image that is in a range of less than 0.5 to about 10 microns. A strength of the laser energy absorbing component may be adjusted by adjusting a concentration of 0.2% to 10% of the laser energy absorbing component in the marking material that forms the image. Preferably, a laser energy absorbing component distribution in the marking material is grainy with concentration variations across length scale of about 1 micrometer. This may enable un-even localized heating. The laser power absorbing component may be a pigment or a dye, for example. Preferably, the laser power absorbing component is a pigment.

A monochrome ink or toner marking material suitable for laser glossing may preferably comprise a black pigment or dye. The black pigment or dye may be selected to have strong absorption of light at a frequency or range of frequencies that corresponds to the frequency or range of frequencies of light emitted by the laser imager used to laser gloss a printed image formed of the marking material. By way of example, carbon black is a preferred pigment due to its wide band of absorption wavelength and low cost. In alternative embodiments, a separate laser absorbing component may be added to the ink or toner to enable or enhance laser absorption.

A color marking material system suitable for laser glossing may include laser glossing compatible color inks or toners. For example, if the laser imager of the imaging device is configured to use laser light in the visible range, an ink having a color complementary to the laser light and black ink may be suitably used for absorbing the laser light. If the laser imager of the imaging device is configured to use laser light in the IR range, then one or more of the colored dye or pigment may be configured or selected to have a strong absorption at the corresponding color of light. Preferably, the colorant that constitutes the light absorbing component is black; black is most likely to exhibit desired IR absorption while maintaining the purity of its visible "color." Preferably, carbon black is selected as the laser power or light absorbing component.

In an embodiment of marking material configured for laser glossing using a laser imager configured to emit IR light, separate IR absorbers may be added to color inks or toners. By way of an example marking material configured for laser glossing, the IR absorbers are transparent in the visible range, and they function to absorb laser energy. Small amounts of IR absorbers (e.g., 0.1-0.3%) may be used. In an exemplary embodiment, the marking material includes IR absorptive ADS1065.

Other suitable IR absorbing pigments include lanthanum hexaboride ($LaB_6$) nanoparticles, and tungsten bronze ($M_xWO_3$) nanoparticles. Suitable IR absorbing dyes include Kayasorb-IRG-022 from Nippon Kayaku, SDA9800 from HWsands, and CIR-180× from Japan Karlit. The combination of an IR laser glossing imager and an IR absorber that is transparent in a visible range of the electromagnetic spectrum, or transparent to visible light including light having a wavelength in a range of about 380 nm to about 740 nm, offers significant advantage to expanding the range of printed areas (colors) which is suitable for laser glossing. Through this approach, nearly all printed area can be made laser glossing suitable without sacrifice the color quality of the original print. The pigment or dye that is tuned for the absorption of the IR laser while mostly transparent for visible light may be blended into one or more toners or inks to form a marking material suitable for laser glossing. An embodiment in accordance with the foregoing is suitable for advantageously enabling the widest range of laser glossing-compatible colors. The one or more toner or inks may include pigmented inks, UV pigmented inks, latex ink, and other types of inks and toners. A marking material in accordance with embodiments may be formed by blending components such as pigments or dyes that absorb light having a desired wavelength with toner or ink.

A solid ink-jet print was formed using pigmented inks with carbon black as the black pigment. The print was subject to laser glossing using a high power IR laser. The print was laser glossed at portions of the marking material image forming the print that contained a fraction of black ink coverage. It has been found that black ink coverage as low as 20% is effective for enabling laser glossing. The laser glossed portion of the marking material image does not require pure black coverage, may instead contain some minimum amount of pigmented black, and may be mixed with other colors as well.

Figure 2:
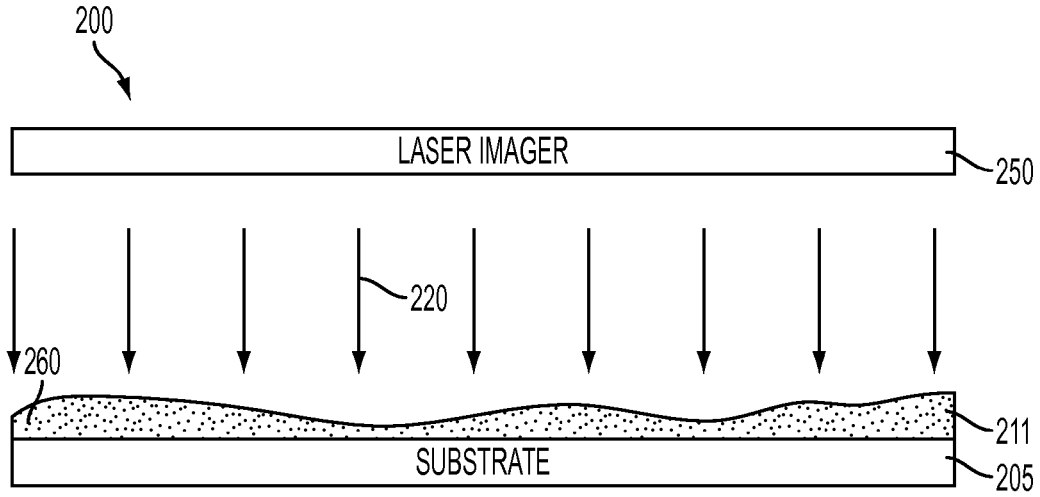
FIG. 2 shows a diagrammatical view of a system for printing a differential gloss image on a substrate using marking material in accordance with an exemplary embodiment.

FIG. 2 shows a laser glossing system and a print having a marking material image formed of marking material containing light absorbing elements in accordance with an embodiment. In particular, FIG. 2 shows a laser glossing system 200. The laser glossing system 200 includes an imaging device configured for exposing a print to high power laser light. The print includes a substrate 205 having a marking material image 211 formed thereon. The marking material image 211 may be formed of ink or toner. The marking material may be advantageously configured to melt after absorbing energy during exposure to laser beam(s) 220.

The imaging device shown in FIG. 2 includes a laser imager 250. The laser imager 250 may be used to apply laser energy onto the marking material image 211. The laser energy may be applied in short duration and may be of sufficiently high power to cause the exposed portion of the ink or toner image to melt. For laser glossing, the laser beam/line is scanned over the toner/ink surface with small spot size. The exposure time for each spot is very short. For example, for a line exposure laser glossing imager (a stationary focused line of laser pattern is generated by the laser glossing imager) at 600 dpi resolution and the substrate moving at 1 m/s speed, the exposure duration is about 40 microseconds. The energy delivered within such a short time is concentrated around the absorber to raise the local temperature quickly. This may cause the surface of the marking material image 211 to be melted momentarily and the surface structure to re-arrange. Shortly after the melting, as the heat diffuses away from the local heating area to the neighboring regions such as substrate, air etc., the image surface re-solidifies and maintains the modified surface texture. This may cause the surface of the marking material image 211 to become rough. For example, a black patch of a print may have a substantial uniform gloss before laser glossing. When the laser imager is applied to selected areas of the black patch, the ink of the areas that are exposed to the laser may become rough because of melting. The areas of the black patch that are not exposed to absorbable electromagnetic radiation from the laser may maintain the original gloss. As a result of applying the laser from the laser imager 250, there may be an image that can be seen as having differential gloss on top of the original printed image. The image on top of the original image may be independent of the underlying original image, and it may be adjusted by varying the laser pattern from the laser imager 250. The substrate 205 may remain substantially the same with minimal or no impact caused by the laser from the laser imager 250.

For some embodiments, the laser imager may be applied using a combination of a beam and an x-y table. For some other embodiments, a line exposure of laser may be created in one direction while the substrate 205 may travel in a different direction such as, for example, a perpendicular direction.

For some embodiments, the power of the laser energy from the laser imager 250 may only be sufficient enough to cause melting of the marking material 211 but may not enough to cause evaporation of ablation of the image 211 or the substrate 205. For example, the energy requirements may be ~1 kW/cm2 (100~10000 W/cm2) for power density, and ~1 J/cm2 (0.1~10 J/cm2) for energy density. This is different from the laser energy typically associated with laser ablation/engraving techniques where the laser energy is strong enough to be used in etching application of hard materials (e.g., stone, ceramic, etc.). For example, the typical laser energy requirements for laser ablation/engraving may be 1~100 MW/cm2 for power density, and 1~100 J/cm2 for energy density, where MW is Mega Watts. In addition, the laser ablation/engraving techniques may cause evaporation or removal of the material, whereas there is minimal or no evaporation or removal of the material caused by the embodiments of the present invention.

The laser energy may not be as strong as the laser energy used in laser ablation/engraving. The marking material may not be homogeneous, so there may be some internal stress. As the material is heated, the internal stress may be relaxed causing some surface roughness. It may be possible for the reverse to occur where, because there may be some surface roughness, the heating may cause it to be smooth by the action of surface tension. It may be noted that the heating may be non-uniform and may be dependent on where the absorbing element is located. This could be caused by the "grainy" (microscopic non-uniform) distribution of the light absorber. This non-uniform local heating at the microscopic scale could further enhance the laser heating induced surface structure. For example, near infrared (IR) laser light is advantageously absorbed by black pigment, which exhibits melting when exposed to radiation from an imaging device such as laser imager 250. By way of further example, when the laser imager 250 is used to expose the marking material to radiation of a different wavelength (e.g., "blue" laser light), then the red pigments may absorb the most energy, and more roughness may occur in areas where there are more red pigments.

The marking material image 211 may comprise ink or toner. The ink or toner may comprise resin or binder, and colorant. The colorant may comprise a pigment and/or dye. Different resin, binder, and colorant have particular corresponding reflection and absorption patterns. Marking material 211 shown in FIG. 2 includes at least one type of absorbing element 260 for absorbing light energy. The absorbing element 260 of the marking material of the image 211 is selected according to its particular absorption properties to cause the marking material to melt when exposed to a laser emitted from the laser imager 250. For example, the marking material of the image 211 may include a monochrome toner or ink compatible with laser glossing that advantageously includes a pigment or dye that absorbs light having a wavelength that corresponds to or falls within a wavelength or range of wavelengths of laser light emitted by the laser imager 250, and constitutes the absorbing element 260. The marking material of the image 211 may include one or more color ink(s) or toner(s), and one or more of the pigments that impart the one or more colors may constitute absorbing elements 260.

If the laser imager 250 is configured to emit visible light to laser gloss a portion of the marking material image 211, then an embodiment may include marking material having ink or toner wherein the ink or toner having a color complementary to the laser light, and/or a black ink or toner will absorb the laser light, and whereby the ink or toner is energized and heated to a temperature sufficient to melt the ink or toner, altering a surface of the marking material image 211 that is exposed to the laser light emitted by the visible wavelength laser imager 250.

If the laser imager 250 is configured to emit light within the infrared range to laser gloss a select portion of the marking material image 211, then an embodiment may include marking material having one or more color pigment or dye components that advantageously absorb light at the wavelength or within a range of wavelengths of light emitted by the IR laser imager 250.

In a preferred embodiment, marking material of the image 211 includes an absorbing element 260 comprising black pigment or dye. Black pigment and dye are preferable at least due to their wide band of absorption wavelengths, and ability to maintain purity of color while suitable for laser glossing. In a preferred embodiment, the absorbing element 260 comprises carbon black. Carbon black is preferred at least due to its low cost.

In a preferred embodiment, the absorbing element 260 distribution in the marking material of the image 211 is "grainy" (microscopic non-uniform or un-even at a length scale of about 1 micrometer) but macroscopically uniform throughout. As shown in FIG. 2, Grainy distribution of absorbing element in the marking material advantageously enables un-even, localized heating upon exposure of the marking material to laser light of a wavelength that is capable of absorption by the absorbing element 260.

In a preferred embodiment, the marking material includes absorbing elements 260 configured to impart upon the marking material of the image 211 an absorption length of laser light that lies in a range of about 0.5 to 10 micrometers. An absorption length of the marking material may be selected by varying the concentration of absorbing elements in the marking material.

In an embodiment, the marking material of the image 211 may include resin and/or binder configured to melt at relatively low temperatures. For example, the resin or binder may melt at less than 500 degrees Celsius. In a preferred embodiment, the resin or binder may melt at less than 250 degrees Celsius. In a preferred embodiment, the resin or binder may melt at less than 150 degrees Celsius. The resin or binder may preferably comprise thermal plastics, wax, or other suitable materials.

In an embodiment, the absorbing elements 260 may be the colorant of the marking material. The absorbing elements 260 may comprise a pigment and/or dye. In a preferred embodiment, the absorbing element 260 comprises a pigment. The absorbing elements 260 may include components of the marking material other than the colorant. The absorbing elements 260 may include components that are tuned for the absorption of the IR light while mostly transparent for visible light.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A marking material system for generating a differential gloss image using a laser glossing imager configured to expose a portion of a printed image to electromagnetic radiation, comprising:

a marking material for forming the printed image; and an absorbing element configured to absorb the electromagnetic radiation, the absorbing element being a component of the marking material, wherein the absorbing element being disposed in the marking material in a concentration sufficient to impart an attenuation length of 0.5 to 10 micrometers in the marking material.

2. The system of claim 1, the marking material further comprising:

a resin or binder, the resin or binder being a resin or binder that melts at a temperature of less than 250 degrees Celsius.

3. The system of claim 1, the marking material further comprising:

a resin or binder, the resin or binder being a resin or binder that melts at a temperature of less than 150 degrees Celsius.

4. The system of claim 1, the marking material further comprising a thermal plastic or wax the thermal plastic or wax being a thermal plastic or wax that melts at a temperature of less than 250 degrees Celsius.

5. The system of claim 1, the marking material comprising at least one colorant component, the absorbing element comprising at least one of the at least one colorant component.

6. The system of claim 5, the absorbing element further comprising:

a pigment.

7. The system of claim 5, the absorbing element further comprising:

a dye.

8. The system of claim 5, the absorbing element further comprising:

carbon black.

9. The system of claim 1, the laser glossing imager comprising an IR laser, the absorbing element being IR light absorptive.

10. The system of claim 9, the IR light absorptive absorbing element being transparent to visible light.

11. The system of claim 1, the absorbing element having an un-even distribution in the marking material for enabling uneven heating of portions of the marking material when exposed to electromagnetic radiation from the laser glossing imager.

12. The system of claim 1, the absorbing element being disposed in the marking material in a concentration of 0.1 to 5%.

13. A marking material system for generating a differential gloss image, comprising:

a marking material for forming the printed image, the marking material comprising an IR light absorptive absorbing element, the absorbing element being transparent to visible light; and a laser glossing imager configured to expose a portion of the printed image to IR light for absorption by the absorbing element, wherein the absorbing element being disposed in the marking material in a concentration sufficient to impart an attenuation length of 0.5 to 10 micrometers in the marking material.

14. The system of claim 13, the absorbing element being a pigment.

15. The system of claim 13, the absorbing element being a dye.

16. The system of claim 13, comprising the absorbing element having a grainy distribution in the marking material.

* * * * *